US005819670A

United States Patent [19]

O'Connor et al.

[11] Patent Number: 5,819,670

[45] Date of Patent: Oct. 13, 1998

[54] WALL-MOUNTED FOLD-DOWN ASSEMBLY

[76] Inventors: Patrick H. O'Connor, 4785 W. 127th Pl., Broomfield, Colo. 80020; Michael M. Peterson, 10908 W. 73rd St., Shawnee, Kans. 66203

[21] Appl. No.: 873,684

[22] Filed: Jun. 12, 1997

Related U.S. Application Data

[63] Continuation-in-part of Ser. No. 484,348, Jun. 7, 1995, Pat. No. 5,655,459.

[51] Int. Cl.[6] ..... A47B 5/00

[52] U.S. Cl. ..... 108/48; 108/134; 182/95

[58] Field of Search ..... 108/42, 47, 48, 108/135, 163; 312/235.1; 182/95, 96, 163

[56] References Cited

U.S. PATENT DOCUMENTS

| | | | |
|---|---|---|---|
| 1,420,206 | 6/1922 | Milam | 108/48 |
| 2,551,345 | 5/1951 | Scott | 182/163 |
| 2,636,549 | 5/1953 | Geller | 108/48 |
| 4,108,457 | 8/1978 | Garrett | 182/95 |
| 4,313,385 | 2/1982 | Fitzgerald | 108/48 |
| 5,655,459 | 8/1997 | O'Connor et al. | 108/48 |

*Primary Examiner*—Peter M. Cuomo
*Assistant Examiner*—Gerold A. Anderson
*Attorney, Agent, or Firm*—Gregory J. Nelson

[57] ABSTRACT

A multiple level or tier foldable bench type seating assembly which is mounted to a wall or bulkhead and which may be folded to a compact position against the wall. A support is secured to the wall. An upper seat support is pivotally attached to the wall support at a bracket. The opposite end is pivotally attached to a rear leg. A lower seat support has a front folding leg and has a roller which travels in a track on the rear leg between the folded and unfolded position. An anti-tampering detent lock prevents the inadvertent or unauthorized folding of the seating.

7 Claims, 6 Drawing Sheets

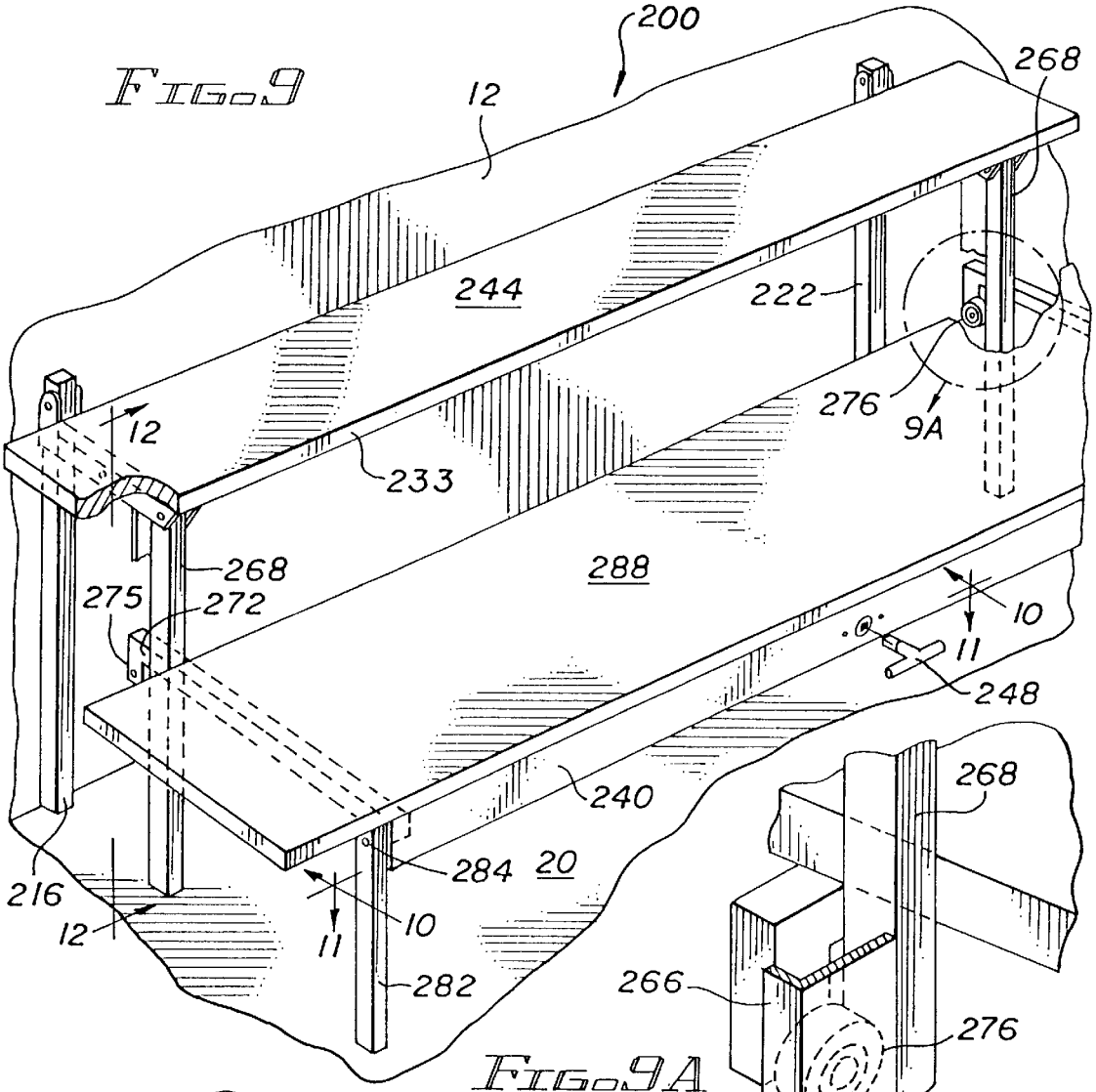
FIG. 9
200
12
268
244
222
276
9A
12
233
268
275
272
288
10
11
248
240
216
284
20
12
11
10
282
266
276
FIG. 9A
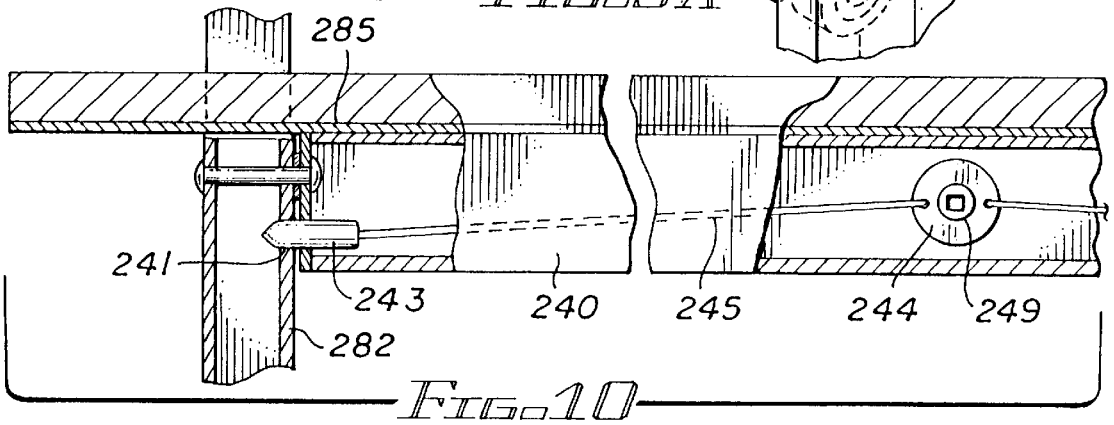
285
241
243
240
245
244
249
282
FIG. 10

WALL-MOUNTED FOLD-DOWN ASSEMBLY

CROSS REFERENCE TO RELATED APPLICATION

This is a continuation-in-part of application Ser. No. 08/484,348, filed Jun. 7, 1995, entitled "Wall-Mounted Fold Down Seat Assembly" now U.S. Pat. No. 5,655,459.

FIELD OF THE INVENTION

The present invention relates to commercial seating and more particularly relates to bench-type seating which accommodates a number of occupants and which may be retracted or folded to a compact, stored, out-of-the-way position against a supporting surface such as a wall occupying only a small floor area.

DESCRIPTION OF THE PRIOR ART

Seating such as foldable or retractable bleachers or bench seating for use in auditoriums, gymnasiums and other public facilities are well known. Seating of this type generally must be collapsed and transported to a separate storage area and when it is desired to be used, it must be transported to the use-area, unfolded and erected. This operation is very time consuming and labor intensive and further requires substantial storage area for the seating when the seating is not erected in a position of use.

Also found in the prior art are various types of folding seating assemblies which are mounted on a wall or vertical support system which are capable of being collapsed in a position against a wall or within a pocket in the wall so as to be out of the way when not in use. The following patents are representative of foldable seating of the various types described above.

U.S. Pat. No. 1,784,390 shows a simple chair or seat which is foldable and is adapted for use in dining alcoves and similar locations which has a pivotal connection between the back and the seat portions so that the seat portion can be swung downwardly to assume a position in line with the back of the chair when not in use.

U.S. Pat. No. 3,873,151 shows a wall-hung, fold-down seat and seat stowage support structure for institutional use such as hospitals, prisons and jails. The device eliminates the use of an angle brace for supporting the seat. The seat is contained in a box-like structure. The seat is retained in its vertical or stowed position within the seat stowage pan by means of a locking member. When the seat is in its horizontal use-position, the rear portion of the seat engages the flat surface which stops the seat from further rotation.

Another type of folding seat is shown in U.S. Pat. No. 4,009,903 which has a retractable seat assembly. The seat assembly moves from the open position to the closed position on bearings. When fully closed, the face portion of the seat member is disposed outwardly from the support to provide an attractive and pleasing appearance. The patentee also emphasizes the advantage of having a retractable seat exposed outwardly, particularly in areas such as gymnasiums where injury to occupants is reduced.

Other types of folding seats, particularly for specialized applications such as aircraft and boats, can be found in U.S. Pat. Nos. 4,460,215 and 4,916,783, respectively.

Thus, while the prior art shows various types of folding and retractable seats and the prior art even suggests seats in which the cushion portion is disposed outwardly in the folded, non-use position, there nevertheless exists a need for improved bench-type seating which is foldable and which may be used in facilities such as gymnasiums, auditoriums and the like. Many of the prior art seating designs described above are individual seats and not adapted for institutional or commercial installation accommodating a large number of users. There also exists a need for bleacher-type seating configurations which are foldable and which allow users to be positioned at several elevations and which folds into a small envelope which does not interfere with the use of the gymnasium or other area.

Also, the present invention represents an improvement over the prior art in that it provides one or two row seating which folds in contrast to conventional seating which folds only at the third row thereby requiring substantial floor space even when folded.

Accordingly, it is an object of the present invention to provide bleacher-type seating for areas particularly smaller gymnasiums and the like, which seating will accommodate use by a number of persons and which occupies little space when folded.

It is another object of the present invention to provide foldable bench-type seating which has several seating levels and folds to occupy small floor space.

Another object of the present invention is to provide foldable seating for commercial use which seating is simple in design, relatively inexpensive to manufacture and may be installed and maintained easily.

Another object of the present invention is to provide foldable bleacher-type seating for areas, particularly areas such as gymnasiums which in the folded condition the seat cushions are disposed outwardly for improved appearance and for safety.

It is a specific object of the present invention to provide a foldable bleacher seating having one or several seating rows, which seating is particularly suited for smaller public areas such as cafeterias and gymnasiums.

SUMMARY OF THE INVENTION

Briefly, in accordance with the present invention, the foldable seating assembly may be secured to any vertical surface such as a wall or bulkhead by a vertical support member. In accordance with one embodiment for single row seating, an L-shaped bracket is pivotally secured to the wall support member at one end and at the other is pivotally secured to a seat support member. The seat support member receives a padded cushion seating member on its upper surface. The forward end of the seat support member is pivotally secured to a leg which supports the seat support member and the cushion in a generally horizontal position when in use. When it is desired to store the seat, the L-shaped bracket is pivoted upwardly which brings the seat cushion to an outwardly disposed position adjacent the horizontal support and in a vertical position close to the wall. The leg depends downwardly along the wall of the floor and may be locked in position at a suitable retainer. The folded seat occupies an envelope of only several inches in width so as to not interfere with use of the areas as a gymnasium or for other activities.

In the event bench seating is required at several levels, the construction described above is modified so that a rear leg of an increased height positions a rear seat support at a higher level establishing multiple tier bench seating. Lower level bench seating is provided by a seating surface on an elongate horizontal rail which is supported at its rear end at a stop bar. The rail has a slot which slidingly receives a pin which is located at an intermediate location along the rear leg. The forward end of the horizontal rail extends forwardly of the seating disposed at the higher level and is supported by a pivotal front leg in the use-position.

When the multiple level seating is collapsed, the upper level bench seating folds in the manner previously described with respect to a one-level bench seating. The lower level seating also folds and the front leg will pivot inwardly beneath the seating surface, assuming a position adjacent the horizontal rail. The horizontal rail will simultaneously pivot and slide upwardly. The resulting construction assumes a position closely adjacent the vertical supporting surface with both the upper and lower seating disposed outwardly for improved appearance and safety.

The above and other objects and advantages of the present invention will be more apparent from the following description, claims and drawings in which:

FIG. 9 is a perspective view of yet another embodiment of the present invention in which the foldable seating of the invention provides rows of bench seating at two elevations;

FIG. 9A is an enlarged detail view of the portion of FIG. 9 indicated by the numeral 9A;

FIG. 10 is a sectional view taken along line 10—10 of FIG. 9;

Figure 1:
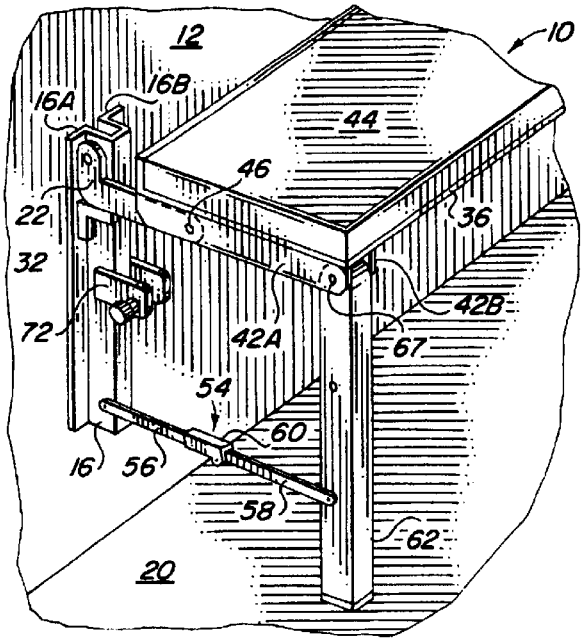
FIG. 1 is a perspective view of a portion of a row of single level bench seating according to one embodiment of the present invention with the section shown in an open position.

Turning now to the drawings, particularly FIGS. 1 through 3B and FIGS. 6 and 7, one embodiment of the folding seating assembly of the present invention is shown and is generally designated by the numeral 10. Embodiment 10 is a single row of bench seating for use in facilities such as auditoriums, gymnasiums, cafeterias and the like. The seating is shown secured to a vertical wall or structure 12 by spaced-apart mounting brackets 16 which as best seen in FIG. 1 are U-shaped channels having flanges 16A and 16B secured to the wall 12 by suitable fasteners, not shown, which may be in the form of bolts, lag screw, anchor bolts or the like.

An L-shaped bracket support 22 is secured to the upper end of the support 16 at a suitable elevation as for example approximately 16"–20" above the floor 20. The bracket 22 is generally L-shaped having spaced-apart legs 26 which are pivotally secured to opposite sides of bracket 16 at pivot pin 30. Legs 24 of the bracket are elongated and in the use-position, extend generally horizontally. A stop plate 32 is mounted to wall 12 and abuts the lower horizontal surface of the leg bracket to support legs 24 in a horizontal position.

A bench surface or deck 36 is supported at intervals by seat support member 42, each consisting of a pair of spaced-apart angle supports 42A and 42B. One leg of each of the supports 42A, 42B is secured to the underside of the seat surface or deck 36 by suitable fasteners such as screws. The bracket 22 and the seat support members 42 are pivotal with respect to one another about pivot pin 46. Pivot pin 46 is located forwardly approximately one-third of the length of the seat support members 42.

Figure 2A:
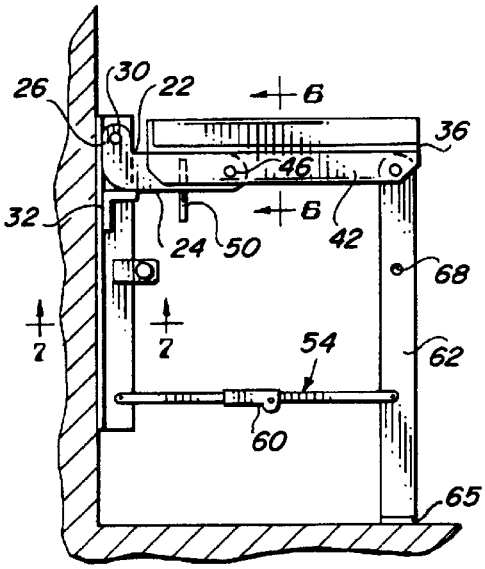
FIGS. 2A–2D illustrate the sequence of operations that take place when the bench of FIG. 1 is folded to a stored position.
Figure 2D:
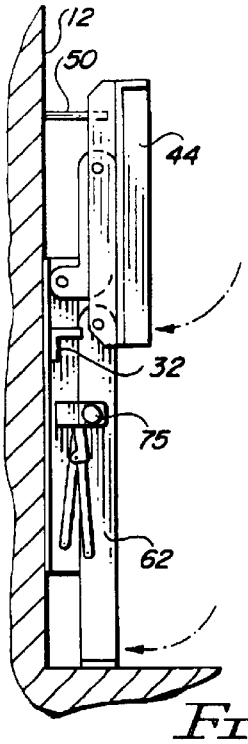
Figure 2C:
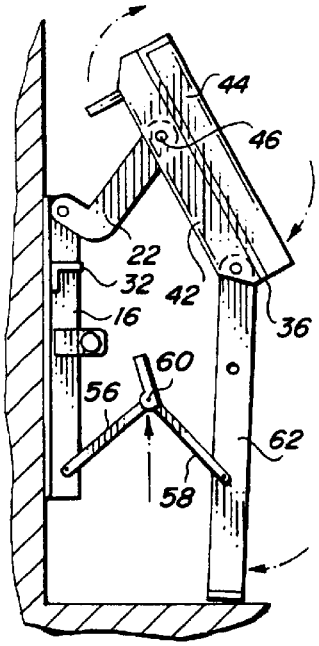
Figure 2B:
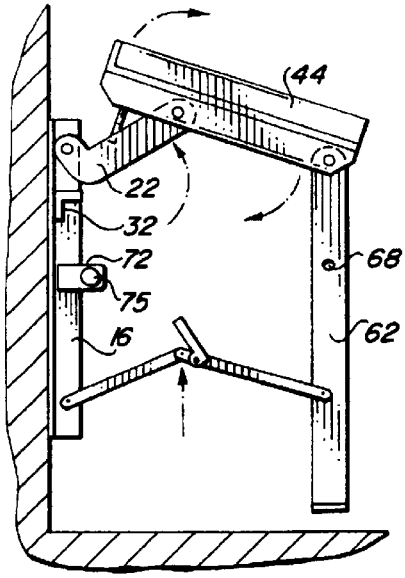

The upper bench surface or deck 36 supports a cushion 44 which may be a resilient foam pad covered by a suitable material such as a vinyl or polyurethane. The seat cushion 44 may be secured in place by adhesive or by use of mechanical fasteners. A stand-off brace 50 depends from the underside of the bench surface or deck at spaced-apart locations to engage the wall 12 in the collapsed or folded position as seen in FIG. 2D.

A foldable brace 54 has members 56, 58 which are pivotally joined at an intermediate location at pivot pin 60 extending in a horizontal position between the leg 60 and the wall when the bench seating is unfolded in a use-position.

A leg 62 is pivotally attached between the forward end of seat support members 42A and 42B at pivot pin 67. The leg 62 has a pad 65 at its lower end of rubber or other resilient material. Leg 62 may be wrapped or coated with a resilient, protective padding material for safety.

Figure 7:
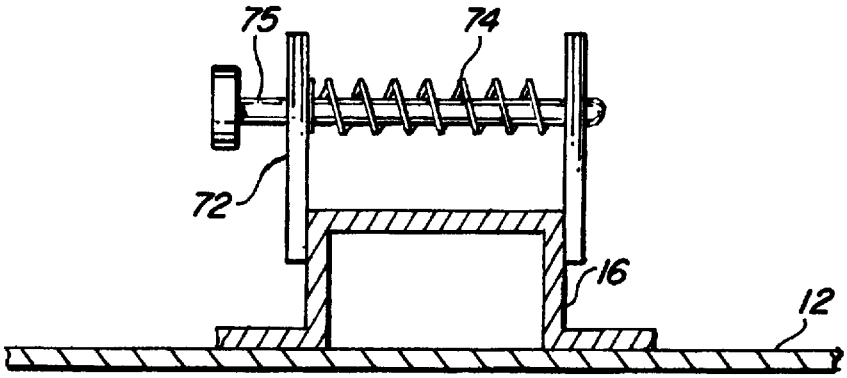
FIG. 7 is a sectional view taken along line 7—7 of FIG. 2A.
Figure 8:
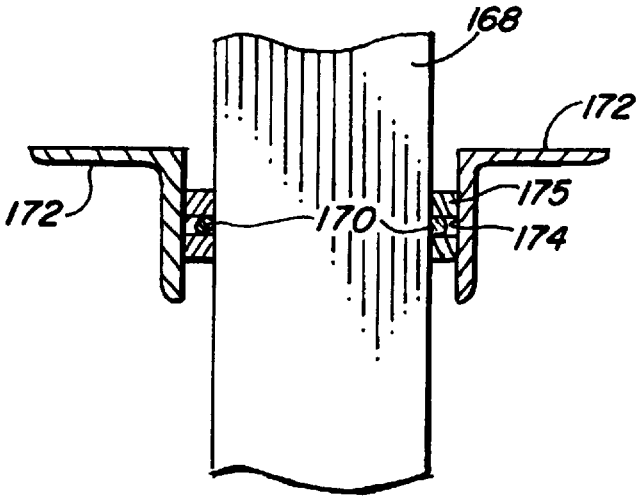
FIG. 8 is a sectional view taken along line 8—8 of FIG. 4A.

The front leg 62 defines a transversely extending bore 68 which, in the folded position, aligns with a retainer plate 72 and secured to the support bracket 16. As best seen in FIG. 7, spring biased detent pin 75 registers with bores 68 to secure the seating in a folded position. The detent pin may be moved leftward compressing spring 74 as seen in FIG. 7 to allow insertion of leg 62. Pin 75 is then released to register with bore 68.

In use, any number of bench seat sections may be provided as required. The sections may be of any suitable length with spacing provided between the wall support brackets 16. Seating units would be typically mounted to a wall surface 12 such as the wall of a gymnasium or cafeteria. An advantage of the foldable seating system of the present invention is that the seating may be folded to a compact storage position against the wall with the resilient cushion 44 disposed outwardly for improved appearance and also to provide a padded surface of the safety of occupants who may contact the seat in the area of the cushion. The advantage of providing an exteriorly positioned cushioning surface when the seating assembly is folded is particularly advantageous in the case of seating used in gymnasiums where physical activity occurs. The searing in a folded condition occupies only a few inches of space outward of the wall.

FIGS. 2A through 2D illustrate the steps in folding the seating to an out-of-the-way position. Initially brace 54 is folded by pivoting the legs 56, 58 relative to one another. The deck or bench surface 36 is then pivoted upwardly which can be manually accomplished by one or more individuals. Lifting the bench surface upwardly will cause the seat supports 42 and the brackets 22 to pivot relative to one another about pivot 46. The cushion 44 moves upwardly as the bench deck 36 is moved rearwardly with the cushion assuming a vertical position as shown in FIG. 2D. The stand-off 50 will engage the wall 12 to maintain the cushion in a generally vertical position when folded. Leg 62 assumes a vertical position against the wall support with bore 68 registering with detent 75. The user will insert the spring-biased detent 75 in position in bore 68 in leg 62 to secure the seating assembly in the folded position.

Figure 3A:
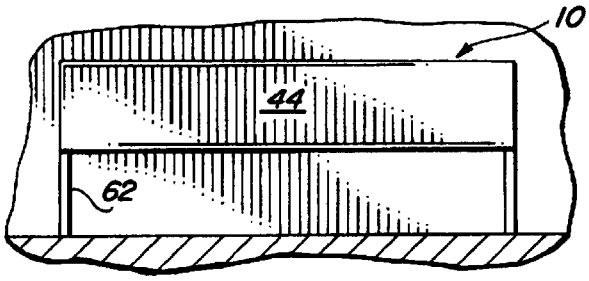
FIG. 3A is an elevational view showing the seating in a folded position.
Figure 3B:
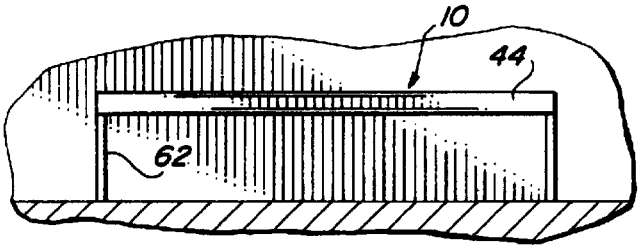
FIG. 3B is an elevational view showing the seating in an open position.

FIG. 3A shows the front or elevational view of the seating when folded and FIG. 3B is a similar view in an open or deployed position.

FIGS. 4A to 5B and FIG. 8 show another embodiment of the present invention which has generally been designated by the numeral 100 and illustrates the present invention applied to multiple row seating in which seating surfaces are provided at two elevations. In this embodiment, the folding seating assembly is again provided in sections of any convenient length with each section being supported by brackets 116 and supports 122 at spaced-apart locations. Each of the supports are wall-mounted and are similar to those described above and each is a generally U-shaped channel having opposite flanges which are secured to the wall 12 by fasteners such as anchor bolts and the like. In this embodiment, two-level bench seating is shown. The upper bench seat is positioned at a suitable elevation above the floor surface 20. The upper seating level is supported by spaced-apart brackets 122 each having a shorter leg 126 which is pivotally attached at pivot pin 130 to the upper end of the support 116. Each bracket has a horizontal leg 124 which extends at right angles with respect to leg 126 and is pivotally secured to seat support 142. The seat support 142 consists of a pair of oppositely disposed angles extending along opposite sides of the bracket 122 and pivotal with respect to the bracket at pivot pin 146.

The upper surface of the seat support 142 has a bench or deck 136 which supports a seat cushion 144. The deck is substantially continuous and may be wood or metal. A leg 168 depends downwardly in the deployed or use-position being pivotally attached at its upper end to the forward end of the support 142 at pivot 162. The construction described above is essentially identical to that shown in FIG. 1 with the exception that the seat cushion 144 is positioned at a higher elevation since the seat is the upper level of a two-level bench seat.

At an intermediate location, as for example approximately 16" to 20" above the floor surface 20, a pair of oppositely extending pins 170 are provided on leg 168. Lower seat support 172 is provided with an elongate slot 174 which receives the pin 170. It is preferred that the support 172 comprise opposed angles and that slot 170 be provided in elongate bearing member 175 horizontally disposed along the interior faces of the angles 172. This is best seen in the cross-sectional view of FIG. 8.

In the erected or use-position, the inner end of support 172 rests on a stop 178 which is a short section of angle iron, welded or otherwise secured to the wall 12. Front leg 182 is pivotally secured to the outer end of the support 172 at pivot pin 184. A lower bench or deck area 185 is disposed on the upper surface of the support 172. One or more cushion sections 186 and 188 are provided on the upper surface of the deck for comfort and safety.

Figure 5A:
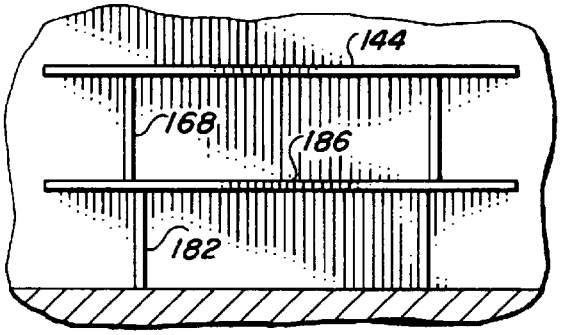
FIG. 5A is an elevational view of the seating of FIG. 4A in an open position.
Figure 5B:
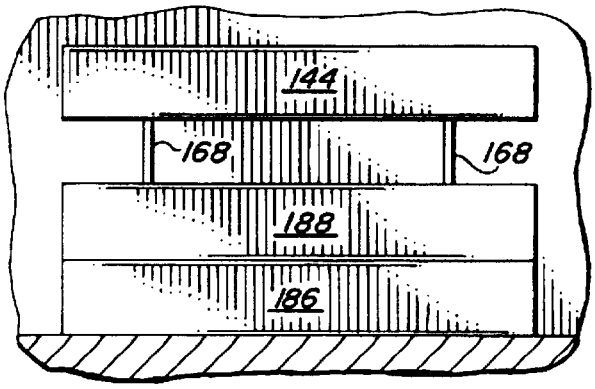
FIG. 5B is an elevational view of the seating of FIG. 4A in a collapsed or folded position.

In the use or deployed position, the multiple row bench seating is as shown in FIGS. 5A and 5B. When it is necessary to fold the bleachers to an out-of-the-way position seen in FIG. 5B, the area formerly occupied by the seating may be used for other purposes, workers will first fold the legs 182 inward and upwardly to a position along the lower support member 172. The lower support member 172 is then simultaneously pivoted upwardly and moved inwardly which move is facilitated by the pin 174 engaging elongate slot 175. When the lower support member and leg 180 have assumed a generally vertical position, the upper bench 136 can be pivoted upwardly and outwardly while simultaneously pivoting pivot bracket upwardly and inwardly. This will result in the leg member 168 assuming a vertical position adjacent the vertical wall bracket. Both the seat cushion on the upper seating row and the lower seat cushions are disposed outwardly for safety and appearance as seen in FIG. 5B.

Figure 4C:
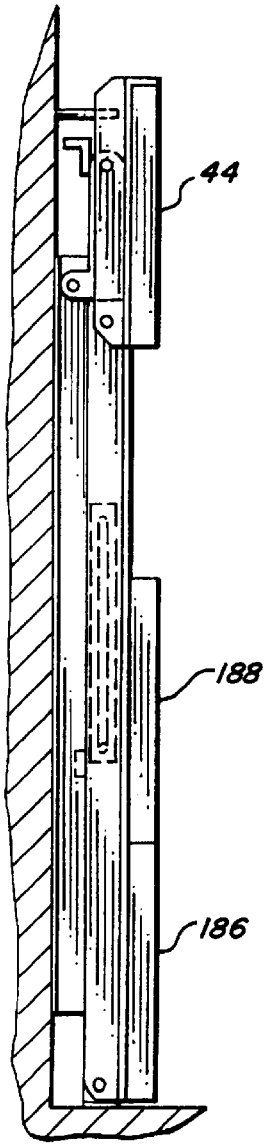
FIGS. 4B and 4C show the sequential operations in moving the seating of FIG. 4A to a compact, folded position.
Figure 4A:
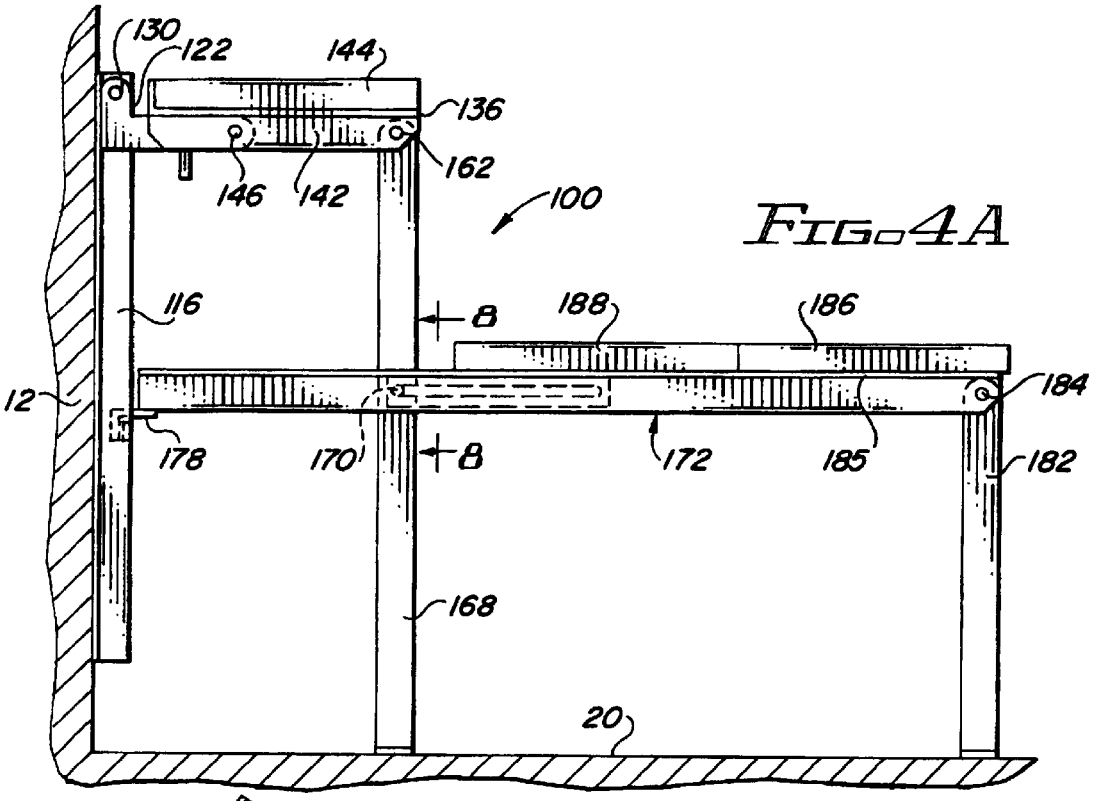
FIG. 4A is a side view of an alternate embodiment of the present invention in which the foldable seating of the invention provides rows of bench seating at two elevations.
Figure 4B:
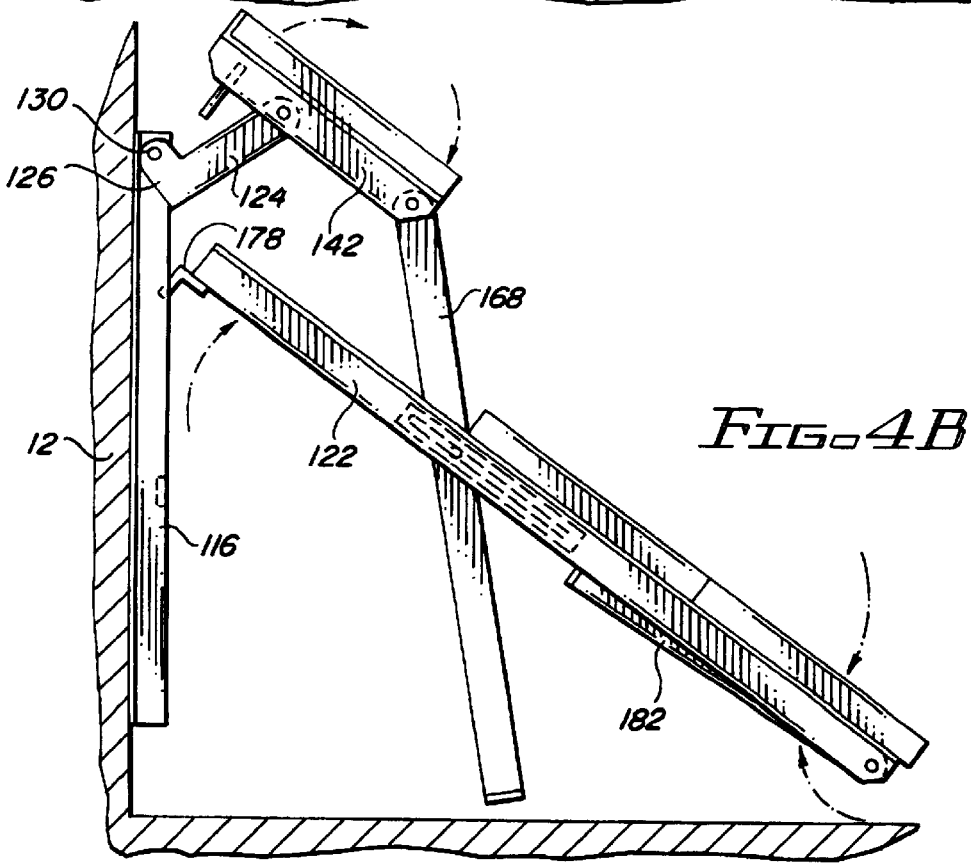
Figure 6:
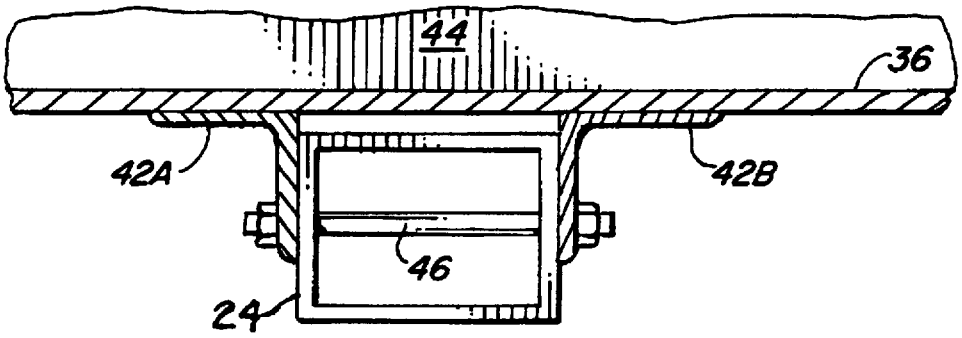
FIG. 6 is a sectional view taken along lines 6—6 of FIG. 2A.

FIGS. 9 through 12C show yet another embodiment of the present invention which has been generally designated by the numeral 200 and is similar to the embodiment of FIG. 4A, illustrating multiple tier seating with seating surfaces provided at two elevations. The folding seating assembly may be provided in sections of any length with each section being supported by supports 216 and supports 222 at spaced-apart locations along a wall 212. Each of the supports are wall-mounted and are similar to those previously described and are shown as being generally U-shaped channels secured to the wall 12 by conventional fasteners such as anchor bolts.

The upper level of the bench seat is positioned at a suitable elevation above the floor surface 20 and is mounted on brackets which are generally L-shaped having a shorter leg 226 and a horizontal leg 224 which extends at right angles with respect to the leg 226. The bracket is pivotally attached to support 216 at pivot pin 230. The seat deck 236 is supported on upper supports 242. The seat supports 242 consist of a pair of structural members such as angles extending along the opposite sides of the bracket 222 and the support is pivotal with respect to the bracket at pivot pin 246.

The upper seat of the seat support 242 carries a bench or deck 236 which supports a seat cushion 244. The deck is substantially continuous and may be of wood or metal as required.

A rear leg 268 depends downwardly in the deployed or use-position being pivotally attached at its upper end to the forward end of support 242 at pivot pin 262. The construction described above is similar to that shown in FIG. 4A.

The lower bench consists of lower seat support 272 which has perpendicular leg member 275 formed at its inner end. The lower end of leg 275 carries a roller 276 which is engaged in a track 266 positioned against the rear surface of leg 268 and extending from an intermediate elevation to near the upper end. The upper surface of seat support 272 carries a deck 285 which may support one or more cushions 288.

The front end of member 272 carries a pivot pin 284 and a shorter front leg 282 is pivotally attached thereto at pivot 284. As best seen in FIG. 9, the bench as described above is supported at spaced-apart locations immediately inward of either end of each deck section.

Figure 11:
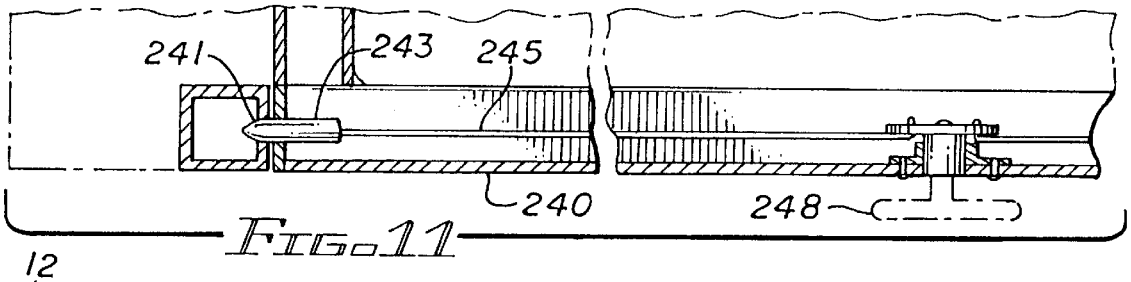
FIG. 11 is a sectional view taken along line 11—11 of FIG. 9.

A detent locking mechanism prevents the leg 282 from inadvertently being folded inwardly or from being folded inwardly by unauthorized personnel. Referring to FIGS. 9, 10 and 11, a bezel plate 240 extends beneath the deck 285 transversely between the adjacent front legs 282 of each bench seating section. Each of the legs defines an aperture

241 which in the locked position receives a detent pin 242. The detent pin 242 is connected to a rotary actuator 244 secured at an intermediate location to the bezel plate 240. A rod or cable 245 extends between the actuator and the detent. It will be seen, rotating the actuator 244 will cause the rod to pull the detent pin to withdraw the detent pin 242 from the aperture 241 of the associated leg allowing the legs to be inwardly collapsed.

To prevent tampering or the unauthorized folding or collapse of the seating, the adaptor preferably requires a special key 248 which would be maintained by the custodian insertable into a socket 249 in the rotary actuator.

Figure 12A:
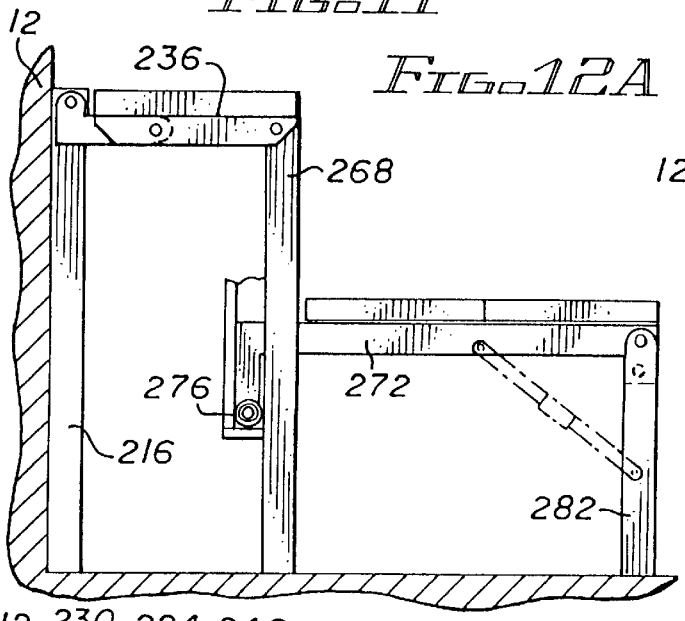
FIG. 12A is a sectional view taken along line 12—12 of FIG. 9.
Figure 12B:
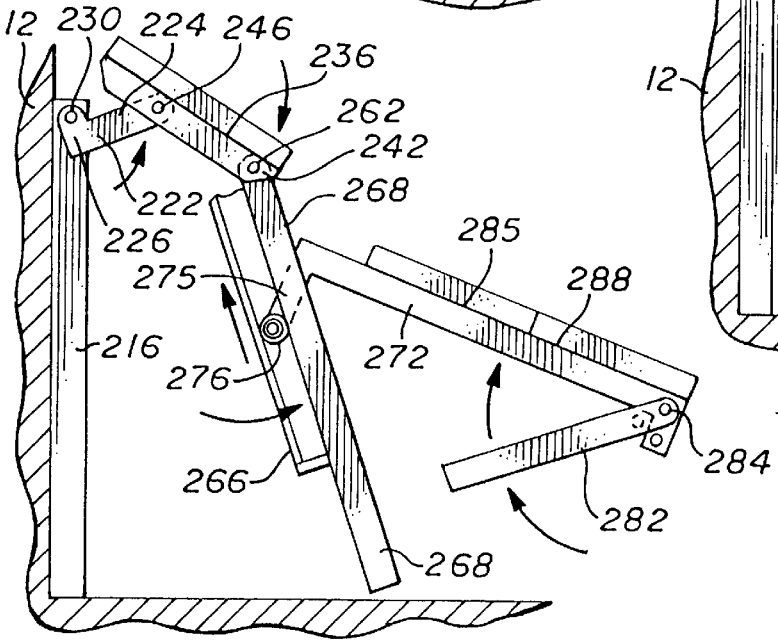
FIG. 12B is a view similar to FIG. 12A with the seating shown in a partially collapsed position.
Figure 12C:
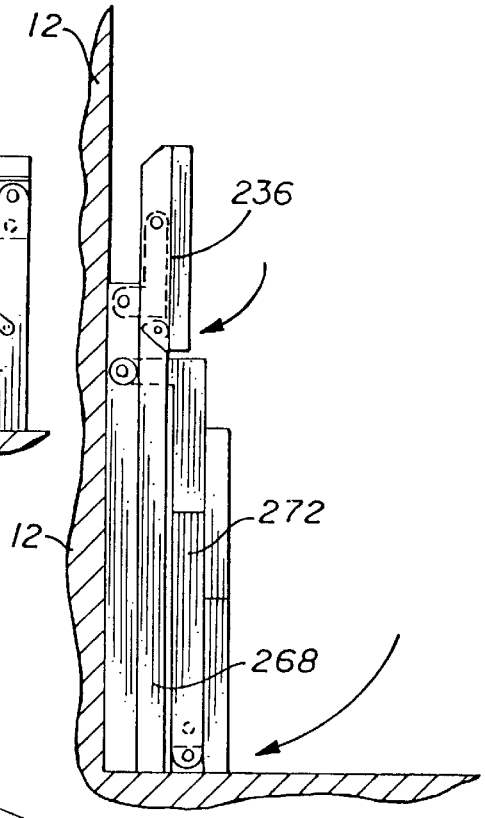
FIG. 12C is a view similar to FIG. 12B with the seating shown in a fully collapsed position.

In the use or deployed position, the two-tiered bench seating is positioned as shown in FIGS. 9 and 12A with the detents 242 engaged in their respective associated legs. In the event it is desired to fold the bench, the custodian will insert the key 248 into the actuator 244 and rotate it to withdraw the detents from the associated legs. This allows the front legs 282 to be folded upwardly. The folding movement of the lower bench is guided at its inner end by roller 276 which moves upwardly in the associated track 266. Simultaneously, the rear leg 268 will pivot inwardly and the upper seat support 242 will pivot about the support bracket at pivot 246. Continued inward movement will allow the seat assembly to assume the position shown in FIG. 12C with the seat compactly collapsed against the wall 12.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. A bench-style multiple tier folding seat assembly for attachment to a vertical wall surface comprising:

(a) a surface mounting support;

(b) a pivotal member having first and second opposite ends, said first end being pivotally secured to said surface mounting support;

(c) a seat support member having a seat supporting surface with a first seating surface thereon and being pivotally secured to the second end of said pivotal member at a location intermediate the first and second ends of said seat support member;

(d) a first leg pivotally secured to the second end of said seat support member whereby in a use-position, said seating surface is supported in a generally horizontal position with said seat support member being in a horizontal position and with said first leg positioned vertically and whereby said folding seat may be folded to a compact storage position adjacent said vertical surface with said seat surface disposed outwardly and said leg extending vertically adjacent said wall surface;

(e) a rail slidable with respect to said inner leg, said rail having first and outer ends;

(f) a second seat-supporting surface disposed on said rail; and (g) a second leg pivotally attached at the outer end of said rail, whereby in said use-position, said first and second surfaces are supported in a generally horizontal position at different elevations and whereby said folding seat assembly may be folded into a compact position adjacent said vertical surface with the first and second seating surfaces disposed outwardly from said wall surface and with said first and second legs disposed generally vertically along said wall surface.

2. The bench-style multiple tier folding seat assembly of claim 1 wherein said rail has a slot therein and said first leg has a pin thereon slidable in said slot.

3. The bench-style multiple tier folding seat assembly of claim 1 wherein said rail has a roller thereon slidable along said first leg.

4. The bench-style multiple tier folding seat assembly of claim 1 further including locking means for selectively locking said second leg in a use-position.

5. The bench-style multiple tier folding seat assembly of claim 4 wherein said locking means comprises detent means on said second seat supporting surface and wherein said second leg defines an aperture selectively registerable with said detent.

6. The bench-style multiple tier folding seat assembly of claim 5 wherein said detent includes a rotary actuator for positioning said detent.

7. The bench-style multiple tier folding seat assembly of claim 6 wherein said rotary actuator is operable by means of a removable key.

* * * * *